US008745783B2

(12) United States Patent
Jansen

(10) Patent No.: US 8,745,783 B2
(45) Date of Patent: Jun. 10, 2014

(54) SUPPORTING SPRING SYSTEM AND FURNITURE FOR SLEEPING, SITTING AND RECLINING COMPRISING A SUPPORTING SPRING SYSTEM

(75) Inventor: Klaus Jansen, Buxtehude (DE)

(73) Assignee: Thomas Beteiligungs- und Vermogens-GmbH & Co. KG, Bremervorde (DE)

( * ) Notice: Subject to any disclaimer, the term of this patent is extended or adjusted under 35 U.S.C. 154(b) by 151 days.

(21) Appl. No.: 13/392,567

(22) PCT Filed: Aug. 13, 2010

(86) PCT No.: PCT/EP2010/004987

§ 371 (c)(1),
(2), (4) Date: Mar. 20, 2012

(87) PCT Pub. No.: WO2011/023307

PCT Pub. Date: Mar. 3, 2011

(65) Prior Publication Data

US 2012/0168997 A1 Jul. 5, 2012

(30) Foreign Application Priority Data

Aug. 31, 2009 (DE) ..... 10 2009 039 321
Sep. 28, 2009 (DE) ..... 10 2009 043 009

(51) Int. Cl.
*A47C 23/06* (2006.01)

(52) U.S. Cl.
USPC ..... 5/236.1; 267/103

(58) Field of Classification Search
USPC ..... 267/97, 99, 101, 103–105; 5/236.1
See application file for complete search history.

(56) References Cited

U.S. PATENT DOCUMENTS

| | | | | |
|---|---|---|---|---|
| 4,567,615 | A * | 2/1986 | Fanti | 5/191 |
| 4,752,981 | A * | 6/1988 | Salens | 5/238 |
| 8,156,583 | B2 * | 4/2012 | Lobry et al. | 5/236.1 |
| 2001/0014984 | A1 * | 8/2001 | Degen | 5/236.1 |

FOREIGN PATENT DOCUMENTS

FR WO 2006/011455 * 11/2006

* cited by examiner

*Primary Examiner* — Christopher Schwartz
(74) *Attorney, Agent, or Firm* — Laurence P. Colton; Smith Risley Tempel Santos LLC

(57) ABSTRACT

A supporting spring system for furniture for sleeping, sitting or reclining, having a plurality of elongated, resilient carrier profiles that have a longitudinal axis and that run parallel to each other, form a common plane, and preferably are mounted on a frame or on longitudinal members. The carrier profiles have at least one reinforcement that is spaced apart from the longitudinal axis, and the profiles can be rotated about the longitudinal axis or an axis parallel thereto in order to change their flexural stiffness against a force in the direction perpendicular to the common plane.

27 Claims, 5 Drawing Sheets

SUPPORTING SPRING SYSTEM AND FURNITURE FOR SLEEPING, SITTING AND RECLINING COMPRISING A SUPPORTING SPRING SYSTEM

STATEMENT OF RELATED APPLICATIONS

This application is the US PCT Chapter II National Phase of PCT/EP2010/004987 having an International Filing Date of 13 Aug. 2010, which claims priority on German Patent Application No. 10 2009 039321.8, having a filing date of 31 Aug. 2009 and German Patent Application No. 10 2009 043 009.1 having a filing date of 28 Sep. 2009.

BACKGROUND OF THE INVENTION

The invention relates to a supporting spring system for furniture for sleeping, sitting or reclining, comprising a plurality of elongated, resilient carrier profiles which have a longitudinal axis and which run parallel to each other, form a common plane and are mounted on a frame or longitudinal members. The invention also relates to furniture for sleeping, sitting or reclining comprising such a supporting spring system.

BRIEF SUMMARY OF THE INVENTION

As a rule, the aforementioned furniture has a spring system comprising what is known as a lattice frame. On the lattice frame there lies a support or padding having a sitting or reclining surface. The spring system is therefore designated a supporting spring system. The lattice frame has a plurality of carrier profiles arranged parallel beside one another at a distance, also designated spring strips in a wooden embodiment. The carrier profiles are normally joined by supporting elements having longitudinal members of a rectangular frame, which is part of the supporting spring system. The carrier profiles extend transversely with respect to the longitudinal members, can have different cross sections and are produced from an extremely wide range of materials. When there is pressure on the padding, the carrier profiles deflect resiliently or bend in a sprung manner.

The object of the present invention is to devise an individually adaptable supporting spring system. In particular, the intention is that the carrier profiles can be adjusted individually or individually in groups.

The supporting spring system according to the invention is a supporting spring system for furniture for sleeping, sitting or reclining, comprising a plurality of elongated, resilient carrier profiles which have a longitudinal axis and which run parallel to each other, form a common plane and are mounted on a frame or longitudinal members, wherein the carrier profiles have at least one reinforcement that is spaced apart from the longitudinal axis, and said carrier profiles are rotatable about the longitudinal axis or an axis parallel to the longitudinal axis in order to change the flexural stiffness of said carrier profiles against a force in the direction perpendicular to the common plane. Thus, the carrier profiles are provided with at least one reinforcement that is spaced apart from the longitudinal axis, and said profiles can be rotated about the longitudinal axis or an axis parallel thereto in order to change their flexural stiffness against a force in the direction perpendicular to the preferably common plane, which can can run in the direction transverse to the longitudinal axis, rectilinearly but also non-rectilinearly, in particular at an angle or curved. The carrier profiles bear directly or indirectly on the padding and can be adjusted to a specific load by means of a simple rotational movement about their longitudinal axes or about axes parallel thereto. In particular, continuous adjustment is possible. The carrier profiles are then mounted appropriately such that they can be rotated continuously. However, an adjustment in small steps or rotational angles is also advantageous. One possible adjustment is preferably such that the rotational angle between the hardest position, on one hand, and the softest position, on the other hand, amounts to 90° or 180°. The carrier profiles can be formed in an extremely wide range of ways, with various cross sections, for example rectangular, square, hexagonal, four-cornered, oval, circular, hollow or solid. The carrier profiles can also have changes in shape and size of the cross section over their length.

According to the invention, the carrier profiles can have two reinforcements spaced apart from the longitudinal axis and located opposite one another. The reinforcements are thus at a distance of 180° from each other. There is then approximately 90° between a relatively hard and a relatively soft position.

According to a further idea of the invention, the reinforcements are in particular tension-resistant inlays in walls or overlays on walls of the carrier profiles. The tension-resistant inlays can be formed by choosing specific materials or by means of increased density of tension-resistant materials that are present in any case. Outside the reinforcements, the carrier profiles have a tensile stiffness that is lower by comparison.

The carrier profiles are advantageously of tubular form with an inner circumferential surface and an outer circumferential surface, wherein the reinforcements are provided in particular on the inside on the inner surface, on the outside on the outer surface and/or between the inner surface and the outer surface. Reinforcements are preferably incorporated between the inner and the outer surface. For instance, the carrier profiles are formed from plastic, specifically as glass-fiber-reinforced (GRP) tubes, and have reinforcements made of carbon fibers in selected cross-sectional areas. Carbon fibers have a higher tensile stiffness than the glass fibers conventionally used for GRP parts, specifically a lower extension under the same load.

According to a further idea of the invention, the carrier profiles have two axes of different flexural stiffness given by the geometry and/or the material, wherein the two axes run approximately perpendicular to each other and in particular also to the longitudinal axis. In this case, there is a rotational angle of 90° between the hardest position and the softest position of the spring element. Individual adjustment of the spring element can be carried out quickly.

According to a further idea of the invention, the carrier profiles have axes of different flexural stiffness perpendicular to each other in cross section. In addition, the carrier profiles have greater dimensions in the direction of one of these axes than in the direction of the other axis. In this specific embodiment, the carrier profiles are not rotationally symmetrical in cross section but, for example, rectangular or oval.

Advantageously, the carrier profiles are held in lateral bearings, rotary bearings or pivoting bearings. Lateral bearings hold the carrier profiles in particular at their ends. In the case of a construction as rotary bearings, the carrier profiles can be rotated in the bearings. The rotary bearings also preferably hold the carrier profiles at their ends. Finally, the aforementioned pivoting bearings can also be provided. These permit the carrier profiles to pivot about an axis at a distance from a central longitudinal axis. Pivoting bearings are in particular provided for non-rotationally symmetrical carrier profiles.

The carrier profiles can be constructed as strips, rods or tubes, with a hollow or solid cross section. The cross section can also change over the length of the carrier profiles, for example as in the case of a barrel shape or as a convex surface of the carrier profiles.

According to a further idea of the invention, two or more carrier profiles can be coupled to one another to form a supporting unit. A geared coupling of two or more carrier profiles in each case can be provided, in particular for rotating the carrier profiles in opposite directions. As a result of the coupling, particularly simple operation is possible. In the event of a geared coupling, by adjusting one spring element, both spring elements of the same supporting unit can be adjusted as a result. The coupling can also be used to ensure a constant distance between adjacent carrier profiles.

Two or more carrier profiles preferably form a common supporting unit of which the flexural stiffness can be adjusted. In particular, two carrier profiles of a supporting unit are held beside each other in a substantially common plane, preferably at a distance from each other. As a result of rotating the carrier profiles and with a perpendicular pressure on the same, transverse forces can act, which lead to lateral deflection of the carrier profiles. If two carrier profiles are coupled, it is possible to compensate for the transverse forces, for example by means of rotation in the opposite direction or by pivoting identical carrier profiles within the same supporting unit.

According to a further idea of the invention, two carrier profiles of a supporting unit can be arranged in each other or can be arranged and held concentrically with respect to each other. For example, a thinner tubular carrier profile is held rotatably in a thicker tubular carrier profile. If the two carrier profiles are rotated relative to each other, the result is different flexural rigidities or moments of resistance. By means of equal rotation of the two tubes in opposite directions, the supporting unit formed in this way will not deflect laterally under a force acting perpendicularly.

Advantageously, the carrier profiles are held such that they can be pivoted about a pivot axis in each case, the pivot axes running at the edge of the cross section or outside the cross section of the relevant carrier profile. The two carrier profiles can be coupled to each other in the region of these pivot axes, in particular with mutually aligned pivot axes. In the simplest case, two rectangular strips are connected to each other via a strip hinge. When the hinge is folded out flat, the result is a low flexural stiffness. As a result of folding both strips in by the same angle in each case—as far as an upright cross section—the flexural stiffness can be increased, and vice versa. In general, two strips or flat profiles which are held such that they can be pivoted can also be provided as carrier profiles within a supporting unit.

According to a further idea of the invention, two or more carrier profiles are provided with a common holder, in particular for maintaining a specific distance or a range of distances between the carrier profiles. The common holders can also be common supporting elements for attachment to the frame or to the longitudinal members. However, the arrangement of supporting elements plus special holders for connecting the two or more carrier profiles to one another is also possible. The holders are formed in such a way that, at least in the region of the holders, the carrier profiles maintain a specific distance. The use of resilient and elastic holders is also possible, so that a specific range of distances between the carrier profiles is maintained.

The holders can have top supporting surfaces, for example for padding. The padding then rests on the supporting surfaces, at least in the region of the holders, otherwise on the carrier profiles or on possible further elements. The supporting surfaces can also be designed so as to deflect in a sprung manner and in this way complement the spring characteristics of the carrier profiles or the supporting unit.

Advantageously, the holders are provided with spring elements or wings, preferably having a spring action in the direction perpendicular to the common plane of the carrier profiles and/or with respect to the distance of the carrier profiles from one another.

According to a further idea of the invention, the carrier profiles are rods or tubes produced by pultrusion. During pultrusion, in particular material-based reinforcements can be incorporated in the cross section of the respective carrier profile, for example carbon fibers instead of or in addition to glass fibers.

A further embodiment of the supporting spring system according to the invention is a supporting spring system for furniture for sleeping, sitting or reclining, comprising a plurality of elongated, resilient carrier profiles that have a longitudinal axis and that run parallel to each other, that form a common plane, and that are mounted on a frame or on longitudinal members, wherein the carrier profiles have two axes of different flexural stiffness given by the geometry and/or the material, wherein the two axes run perpendicular to each other and to a longitudinal axis, wherein in each case at least two of the carrier profiles are coupled to one another to form a supporting unit, and wherein the at least two of the carrier profiles within the supporting unit are rotatable or pivotable. This provides for the carrier profiles to have two axes of different flexural stiffness given by the geometry and/or the material, wherein the two axes preferably run perpendicular to each other and in particular also to the longitudinal axis, wherein in each case two or more carrier profiles are coupled to one another to form a supporting unit. The axes of different flexural stiffness are thus combined with the idea of coupling two or more carrier profiles to form a supporting unit. The carrier profiles within the same supporting unit can preferably be rotated or pivoted with respect to one another. The axes of different flexural stiffness can also run congruently or parallel.

The supporting spring system according to the invention explained last can be combined with all or some of the features previously explained.

The subject of the invention is also furniture for sleeping, sitting or reclining comprising a supporting spring system corresponding to the features and properties explained above.

Further features of the invention can otherwise be gathered from the description and from the claims.

BRIEF DESCRIPTION OF THE DRAWINGS

Preferred exemplary embodiments of the invention will be explained in more detail below by using the drawing, in which:

FIGS. 1*a* to 2*c* show cross sections through tubular carrier profiles arranged in pairs with overlapping holders.

FIGS. 2*a* to 2*c* show illustrations analogous to FIGS. 1*a* to 1*c*.

DETAILED DESCRIPTION OF PREFERRED EMBODIMENTS

A supporting spring system for padding (mattress) of a bed has a plurality of carrier profiles 10, 11 arranged in pairs, which are tubular in the figures, if not otherwise indicated. Each carrier profile 10, 11 is formed with two orthogonal axes s, w of different flexural stiffness. To this end, the carrier profiles 10, 11 have reinforcements 12, 13 on the circumference, in each case provided at a distance from each other. The reinforcements 12, 13 can be formed by materials otherwise differing from the carrier profile or provided in addition.

The carrier profiles 10, 11 are mounted such that they can rotate about their longitudinal axes. During rotation, the flexural stiffness changes with respect to a force F acting from above on the carrier profiles 10, 11 arranged horizontally beside one another.

Figure 1:
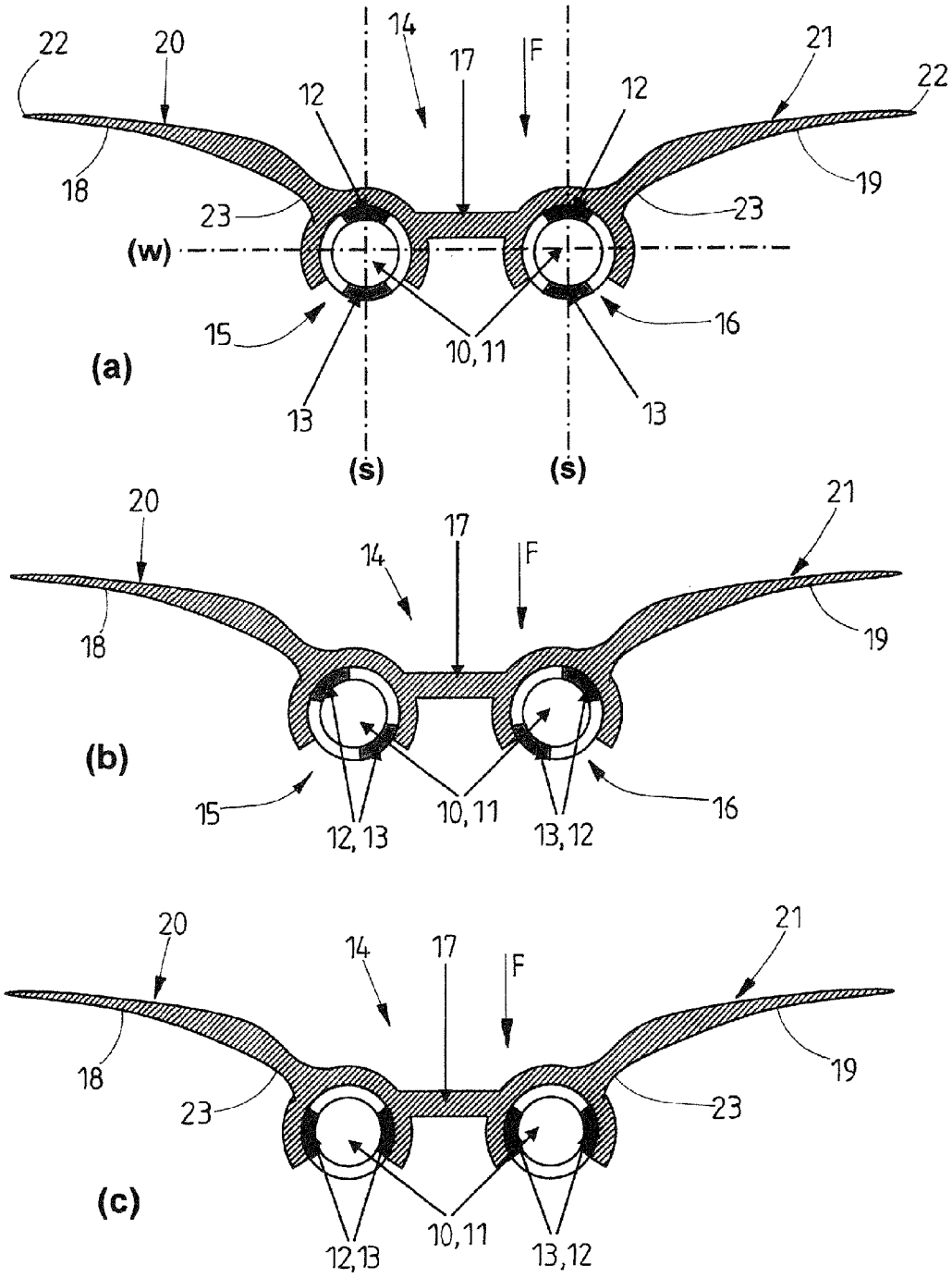

In the illustration according to FIG. 1*a*, the carrier profiles 10, 11 exhibit the greatest flexural stiffness against the action of the force F on account of the reinforcements 12, 13 in each case located at the top and bottom. Now, if the carrier profiles 10, 11 are rotated in opposite directions in relation to each other, as illustrated in FIG. 1*b*, the reinforcements 12, 13 reach an intermediate position with axes s and w directed obliquely. By means of further rotation of the carrier profiles 10, 11, the reinforcements 12, 13 in each case come to lie laterally, see FIG. 1*c*. Accordingly, in FIG. 1*c* the axes s would run horizontally and the axes w would run vertically. The flexural stiffness is lowest in the position according to FIG. 1*c*.

By means of specific rotation of the carrier profiles 10, 11 to a greater or lesser extent, any desired intermediate values with regard to the flexural stiffness can be set between the maximum according to FIG. 1*a* and the minimum according to FIG. 1*c*, specifically including the intermediate value according to FIG. 1*b*. In this position, the result of a force F would be that the carrier profiles 10, 11 would not only deflect downward but also slightly laterally, on account of the forces and opposing forces acting overall. This lateral movement is counteracted by one or more holders 14 that are fitted. The holder 14 here has two receptacles 15, 16 for the carrier profiles 10, 11, a central web 17 for connecting the receptacles 15, 16, and lateral wings 18, 19 having supporting surfaces 20, 21 for the padding, not shown.

The receptacles 15, 16 have a partly circular cross section and are open at the bottom. The partly circular cross section extends over about 210° to 270°. The holders 14 can therefore be pushed onto the carrier profiles 10, 11, given appropriate elasticity of the material used. Alternatively, the receptacles 15, 16 can also be of closed form. The carrier profiles 10, 11 could then be pushed into the receptacles 15, 16 in the direction at right angles to the image plane.

The wings 18, 19 can be designed to be rigid or springy, so that, complementing the elasticity of the carrier profiles 10, 11, the inherent elasticity of the wings 18, 19 is effective with respect to the padding, not shown. The material for the holders 14 must be chosen accordingly. It is preferably elastically resilient plastic.

Each wing 18, 19 is formed with a thickness decreasing toward its end 22. In addition, there is a slight narrowing 23 in cross section close to the respectively adjacent receptacle 15 or 16. As a result, the respective wing 18, 19 is able to adapt as well as possible to the pressure acting as a result of the padding, not shown.

Figure 2:
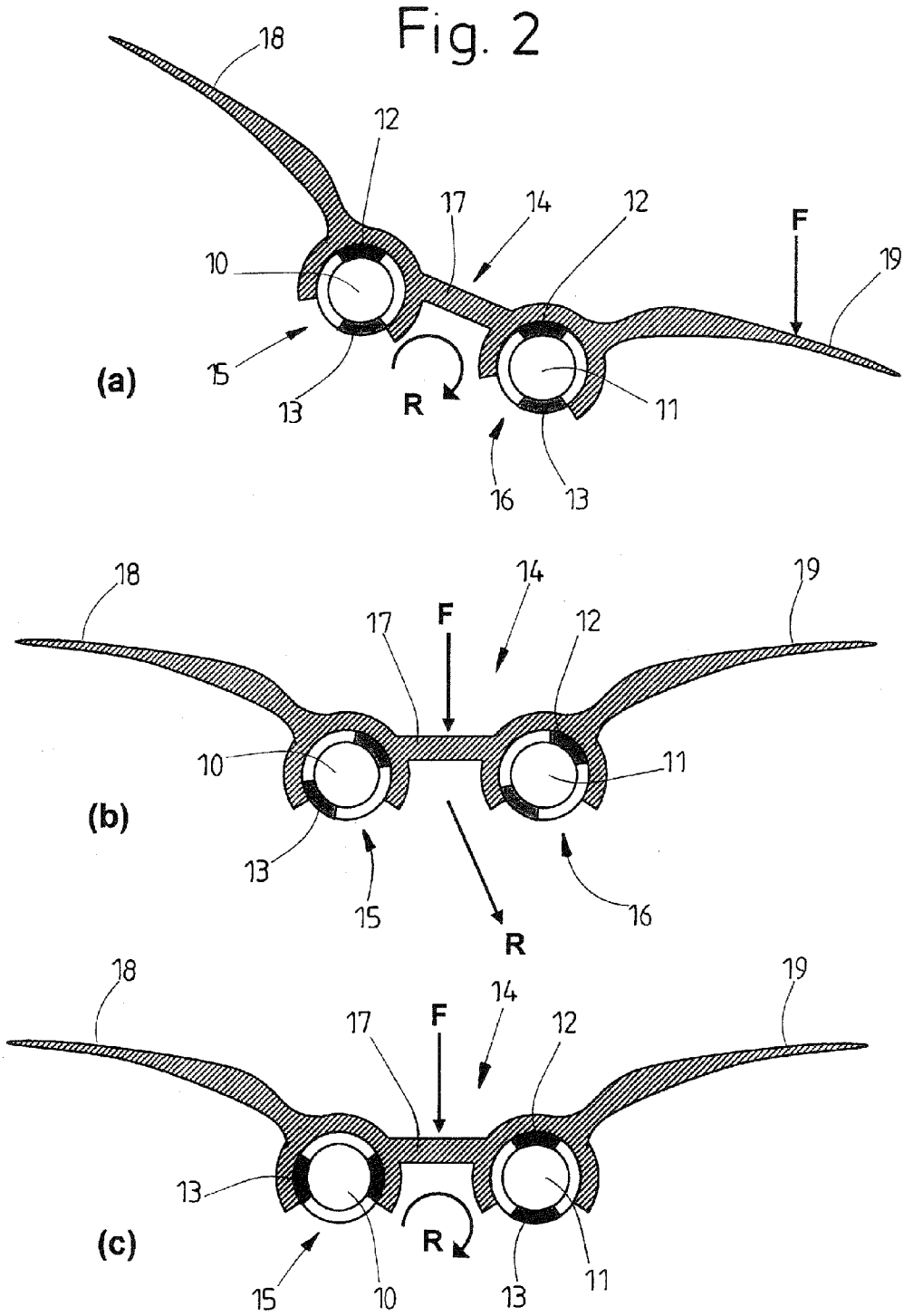

As a result of the elasticity of the carrier profiles 10, 11, the holder 14 with the wings 18, 19 can be rotated as a whole in the event of a force F acting on one side in a corresponding way—as shown in FIG. 2*a*. The resultant rotational movement is illustrated by the arrow R in FIG. 2*a*.

FIG. 2*b* shows a modification of FIG. 1*b*. As opposed to FIG. 1*b*, the carrier profiles 10, 11 are rotated through about 45° in the same direction (parallel). A force F acting on the holders 14 centrally from above then leads to a slightly laterally offset reaction movement R. If two such pairs of carrier profiles and corresponding holders are provided, and with rotation of the carrier profiles of one pair in one direction and the other pair in the opposite direction, an extension or compression of the padding under more intense loading can then be set deliberately.

FIG. 2*c* shows a third variant in relation to FIGS. 1*b* and 2*b*. Here, the two carrier profiles of the same holder 14 are rotated in relation to each other in such a way that the left-hand carrier profile 10 exhibits the minimum flexural stiffness and the right-hand carrier profile 11 exhibits the maximum flexural stiffness. A vertical force F acting centrally then leads to slight rotation of the holder 14 with the wings 18, 19 in the direction of the arrow R.

Figure 3:
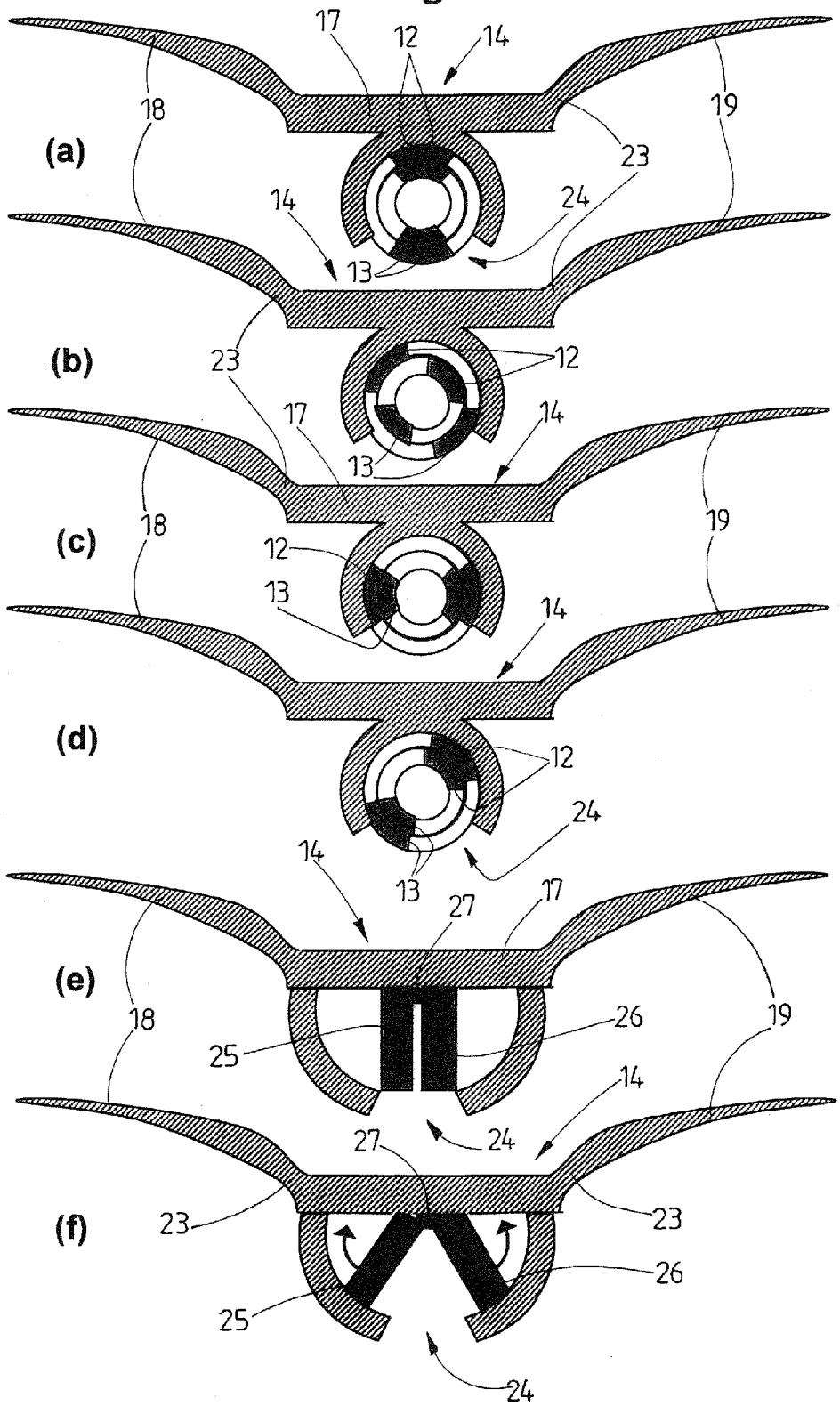
FIGS. 3*a* to 3*f* show cross sections of tubular carrier profiles pushed into one another with a holder placed thereon.

FIGS. 3*a* to 3*d* show carrier profiles 10, 11 lying inside one another, specifically concentrically arranged tubes. The holder 14 is seated with a receptacle 24 on the respective outer carrier profile 10. Possible, for example, are the rotatable mounting of both carrier profiles 10, 11 in each case on one side in corresponding supporting elements or the rotatable mounting of a first of the two carrier profiles on both sides and the rotatable mounting of the second carrier profile in or on the first carrier profile. FIG. 3*a* shows a rotational angle of the carrier profiles 10, 11 with maximum flexural stiffness—a hard setting. FIG. 3*b*, by contrast, shows a position of the carrier profiles partially rotated in opposite directions—a medium setting. A soft setting is finally shown by FIG. 3*c*, with carrier profiles 10, 11 rotated through 90° as compared with FIG. 3*a*.

FIG. 3*d* is comparable with FIG. 2*b*. A force acting on the holder 14 perpendicularly from above additionally results in a slight lateral offset of the holder 14.

FIGS. 3*e* and 3*f* do not show tubes but rectangular strips. The carrier profiles 25, 26 formed as rectangular strips here can be angled or pivoted in the common receptacle 24 about a linear bearing 27 located at the top. FIG. 3*e* shows a parallel position of the carrier profiles 25, 26 at a short distance, upright in cross section, while in FIG. 3*f* a position of the carrier profiles 25, 26 pivoted partially upward and outward is shown. Depending on the position of the carrier profiles 25, 26, the result for FIGS. 3*e* and 3*f* is a substantially inverted V-shaped arrangement of the carrier profiles. In the parallel illustration according to FIG. 3*e*, there is a high flexural stiffness, while a lower flexural stiffness results from the pivoted arrangement according to FIG. 3*f*.

The common factor in the exemplary embodiments of FIGS. 1*a* to 3*f* is the formation as a double element, specifically with two carrier profiles forming a spring unit, and the possibility of the common, symmetrical or asymmetrical adjustment of the carrier elements. In addition, the wings 18, 19 are arranged as spring elements in each case on the left and right of the carrier profiles 10, 11 and 25, 26, respectively.

Figure 4:
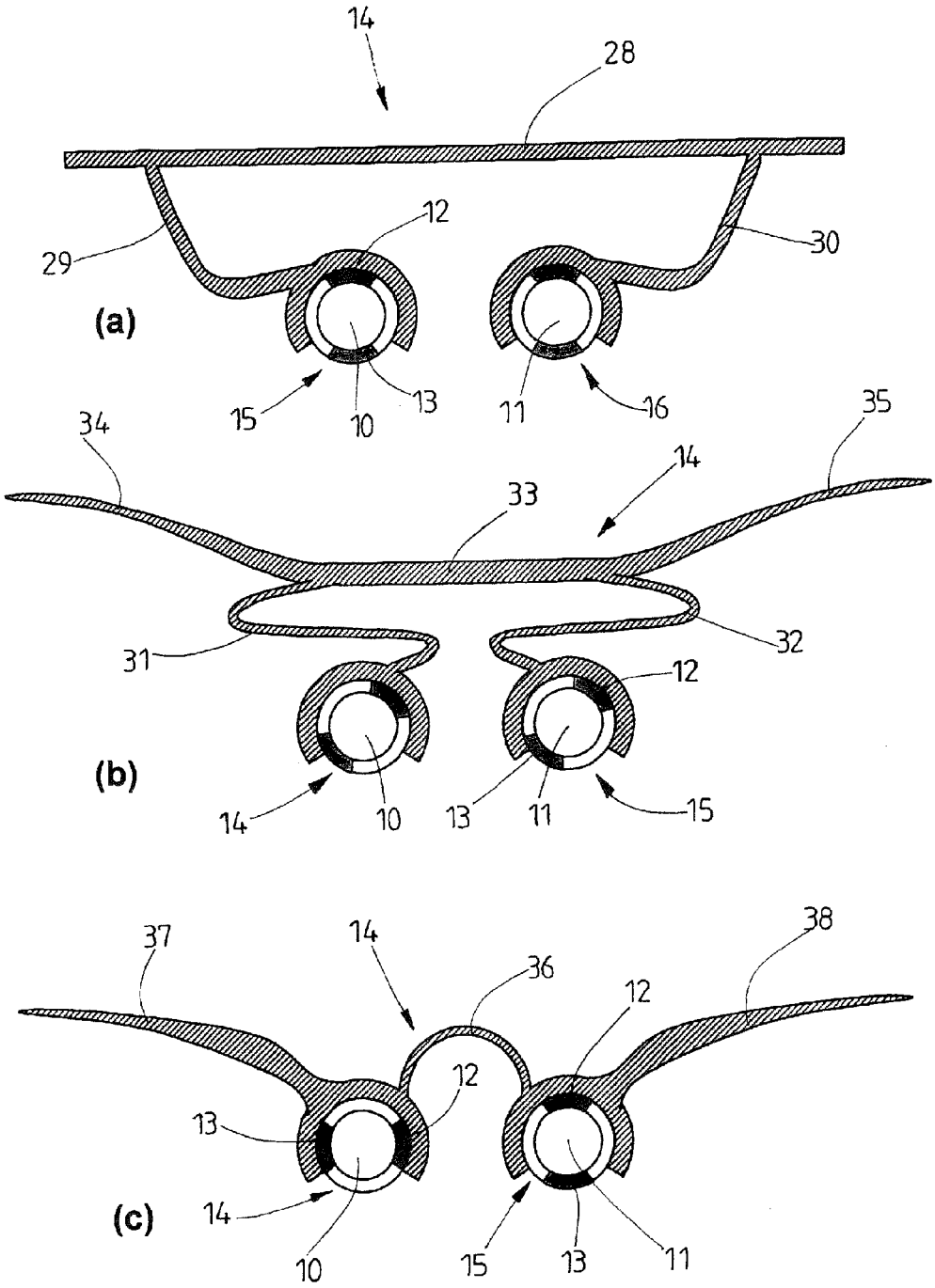
FIGS. 4*a* to 4*c* show illustrations analogous to FIGS. 1*a* to 1*c* but with differently formed holders.

Alternative embodiments are shown by FIGS. 4*a* to 4*c*. In FIG. 4*a*, a holder plane 28 is provided, which rests rigidly or elastically on the carrier profiles 10, 11 arranged in pairs. To this end, the receptacles 15, 16 for the two carrier profiles 10, 11 are held on carriers 29, 30 which are curved downward and simultaneously inward. The carriers 29, 30 can be designed to be elastic or rigid.

The example in FIG. 4*b* is similar to the illustration in FIG. 4*a* but with carriers 31, 32 clearly elastically formed and with springy wings 34, 35 adjoining a shortened holder plane 33. Finally, FIG. 4*c* shows an exemplary embodiment with elastic coupling 36 of two wings 37, 38 with receptacles 15, 16. This overall arrangement exhibits increased torsional stability, which can also be configured adjustably.

The carrier profiles 10, 11 and 25, 26 shown can also have differing cross-sectional profiles and, for example, be configured hexagonally or in another way. An octagonal profile would have the advantage that, for example, the rotational angles (0°, 45°, 90° that can be seen in FIGS. 1*a*, 1*b*, 1*c* do not change under load following setting. The cross-sectional profile acts in a manner stabilizing the rotational angle.

Figure 5:
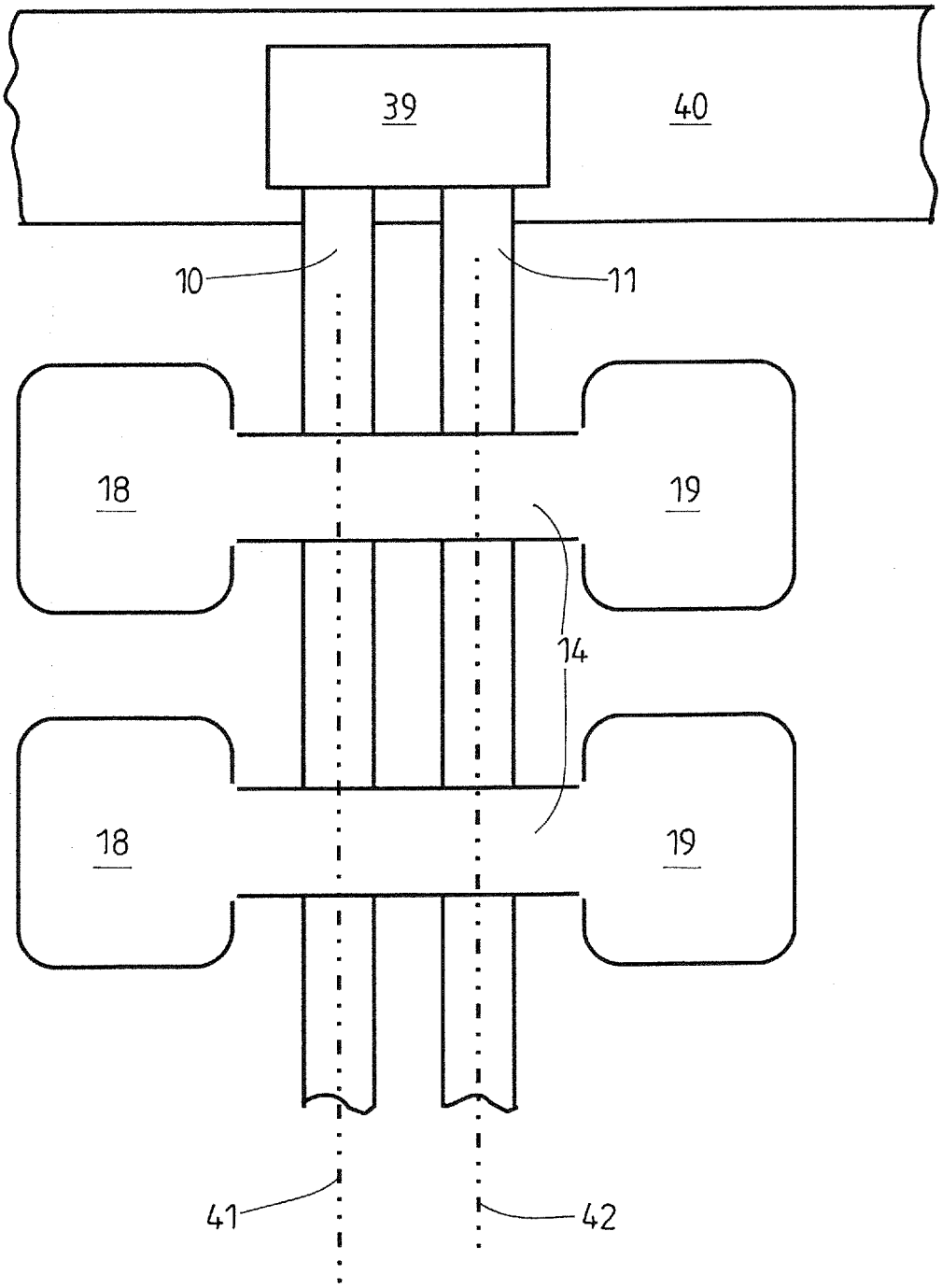
FIG. 5 shows a schematic plan view of part of a supporting spring system comprising carrier profiles arranged beside one another in pairs and holders placed thereon comprising spring elements, as illustrated in FIGS. 1*a* to 1*c*.

The plan view according to FIG. 5 shows the mounting of the carrier profiles 10, 11 in pairs in or on a supporting element 39 on a longitudinal support 40 of a frame, which is part of a supporting spring system. The supporting element 39 here is at the same time a lateral bearing for mounting two carrier profiles in each case. Longitudinal axes 41, 42 of the carrier profiles run parallel to one another in a horizontal plane. The carrier profiles 10, 11 are also coupled outside the supporting element 39 by the holders 14, which here have the wings 18, 19 shown in FIGS. 1*a* to 1*c*. Along the carrier profiles 10, 11, the holders 14 are fitted at a distance from one another. Here, the holders 14 are formed so as to be considerably narrower in the direction of the longitudinal axes 41, 42 than the wings 18, 19. Other proportions are possible. In addition, instead of a plurality of holders 14, a single relatively wide holder can be provided.

Likewise possible is an embodiment in which the carrier profiles 10, 11 are coupled to one another by gearing or in another way.

In all the embodiments, manual adjustment of the carrier profiles is provided. However, a motorized drive is also possible.

In a departure from the exemplary embodiments shown in the figures, carrier profiles 10, 11 without holders or wings can also be provided.

A minimum solution would be the use of carrier profiles not in pairs but carrier profiles arranged individually and at a distance from one another, which are preferably rotatably mounted in corresponding supporting elements and in particular also permit small rotational angles (as illustrated in the figures). Between the hardest and the softest setting, there is preferably a rotational angle of 90°, as also illustrated in the figures.

The carrier profiles 10, 11 illustrated in the figures are in particular produced by pultrusion and are preferably composed of plastic with embedded carbon fibers or glass fibers or other materials defining a specific stiffness. For example, carbon fibers can be provided in the region of the reinforcements 12, 13 shown, while the carrier profiles 10, 11 are otherwise (only) glass-fiber reinforced. As a result of the various properties of said reinforcing materials, the different flexural stiffnesses in the direction of the axes s and w result, see FIG. 1*a*. The already mentioned rotational angle of 90° between the hardest and softest settings results from the position of the relatively stronger reinforcements 12, 13 of carbon fibers located opposite one another in the cross-sectional profile.

The reinforcements illustrated in FIGS. 1*a* to 3*d* extend substantially over the entire thickness of walls of the tubular carrier profiles 10, 11. Likewise, the reinforcements 12, 13 extend in the circumferential direction in each case over about 30° to 90°, preferably about 60°. However, the reinforcements can also be formed and/or embedded in another way, for example as one or more round rod-like inlays. Finally, the reinforcements can also be applied to the carrier profiles on the inside or outside.

| List of designations | |
|---|---|
| 10 | Bed |
| 11 | Bed frame |
| 12 | Supporting frame |
| 13 | Supporting spring system |
| 14 | Mattress |
| 15 | Longitudinal direction |
| 16 | Strip |
| 17 | Spring element |
| 18 | Supporting plate |
| 19 | End |
| 20 | Intermediate piece |
| 21 | Bearing means |
| 22 | Longitudinal side |
| 23 | Side beam |
| 24 | End |
| 25 | Transverse strut |
| 26 | Ring |
| 27 | Locking means |
| 28 | Upper half |
| 29 | Lower half |
| 30 | Closure |
| 31 | Aperture |
| 32 | Bearing shell |
| 33 | Latching projection |
| 34 | Latching projection |
| 35 | Groove |
| 36 | Longitudinal profile |
| 37 | Transverse profile |
| 38 | Vertical limb |
| 39 | Horizontal limb |
| 40 | Bearing means |
| 41 | Ring |
| 42 | Foot |
| 43 | Claw |
| 44 | Bearing means |
| 45 | Stop piece |
| 46 | Pocket |
| 47 | Pocket |
| 48 | Foot |
| 49 | Claw |
| 50 | Filler piece |
| 51 | Filler piece |
| 52 | Bearing means |
| 53 | Stop piece |
| 54 | Foot |
| 55 | Claw |
| 56 | Pocket |
| 57 | Convexity |
| 58 | Filler piece |
| 59 | Bearing means |
| 60 | Bellows |
| 61 | Claw |
| 62 | Claw |
| 63 | Stop damper |

The invention claimed is:

1. A supporting spring system for furniture for sleeping, sitting or reclining, comprising a plurality of elongated, resilient carrier profiles (10, 11; 25, 26) each of which have has a longitudinal axis and which run parallel to each other and in a common plane, wherein the carrier profiles (10, 11; 25, 26) have a changeable flexural stiffness and at least one reinforcement (12, 13) that is spaced apart from the longitudinal axis, and the carrier profiles are rotatable either about the longitudinal axis or about an axis parallel to the longitudinal axis, in order to change the flexural stiffness of the carrier profiles against a force in a direction perpendicular to the common plane.

2. The supporting spring system as claimed in claim 1, wherein at least two of the carrier profiles (10, 11; 25, 26) form a common supporting unit of which the flexural stiffness can be adjusted.

3. The supporting spring system as claimed in claim 2, wherein two of the carrier profiles (10, 11; 25, 26) of the common supporting unit are held beside each other in a substantially horizontal common plane, at a distance from each other.

4. The supporting spring system as claimed in claim 2, wherein two of the carrier profiles (10, 11; 25, 26) of the common supporting unit are arranged in each other or are arranged and held concentrically with respect to each other.

5. The supporting spring system as claimed in claim 2, further comprising two strips or flat profiles that are held such that the strips or flat profiles are provided as the carrier profiles (25, 26) within the common supporting unit.

6. The supporting spring system as claimed in claim 2, wherein two of the carrier profiles (10, 11; 25, 26) of the common supporting unit are arranged in each other or are arranged and held concentrically with respect to each other.

7. The supporting spring system as claimed in claim 1, wherein at least two of the carrier profiles (10, 11; 25, 26) are provided with a common holder, for maintaining a specific distance or a range of distances between the at least two of the carrier profiles (10, 11; 25, 26).

8. The supporting spring system as claimed in claim 7, wherein the common holder (14) has top supporting surfaces (20, 21), that deflect in a sprung manner relative to the carrier profiles (10, 11; 25, 26).

9. The supporting spring system as claimed in claim 7, wherein the common holder (14) has spring elements (18, 19), having a spring action in one of (a) in a direction perpendicular to the common plane of the carrier profiles, (b) with respect to the distance of the carrier profiles from one another, and (c) in a direction perpendicular to the common plane of the carrier profiles and with respect to the distance of the carrier profiles from one another.

10. The supporting spring system as claimed in claim 1, wherein at least of the two carrier profiles (10, 11; 25, 26) are coupled to one another to form a supporting unit.

11. The supporting spring system as claimed in claim 10, wherein at least two of the carrier profiles (10, 11; 25, 26) comprise a geared coupling for rotating the at least two of the carrier profiles (10, 11; 25, 26) in opposite directions.

12. The supporting spring system as claimed in claim 1, wherein the carrier profiles (10, 11; 25, 26) are held such that each of the carrier profiles (10, 11; 25, 36) is pivotable about a pivot axis, the pivot axis running at an edge of a cross section of the respective carrier profile (10, 11; 25, 26) or outside of the cross section of the respective carrier profile (10, 11; 25, 26).

13. The supporting spring system as claimed in claim 12, wherein two of the carrier profiles (10, 11; 25, 26) are coupled to each other in the region of their pivot axes, with their pivot axes being mutually aligned with each other.

14. The supporting spring system as claimed in claim 1, wherein the carrier profiles (10, 11; 25, 26) are mounted on a bed frame, the bed frame having longitudinal members extending in a longitudinal direction, and the carrier profiles (10, 11; 25, 26) extend from one of the longitudinal members to another of the longitudinal members.

15. The supporting spring system as claimed in claim 14, wherein the carrier profiles (10, 11; 25, 26) extend transversely to the longitudinal direction, namely across a width of the bed frame.

16. The supporting spring system as claimed in claim 1, wherein the at least one reinforcement (12, 13) is spaced apart from the longitudinal axis and located opposite another one of the at least one reinforcement (12, 13).

17. The supporting spring system as claimed in claim 1, wherein the at least one reinforcement (12, 13) is a tension-resistant inlay in the carrier profiles (10, 11; 25, 26).

18. The supporting spring system as claimed in claim 1, wherein the carrier profiles (10, 11; 25, 26) are of tubular form with an inner circumferential surface and an outer circumferential surface, wherein the at least one reinforcement (12, 13) is provided (a) on the inner circumferential surface, (b) on the outer circumferential surface, (c) within the tubular form between the inner circumferential surface and the outer circumferential surface, and (d) combinations thereof.

19. The supporting spring system as claimed in claim 1, wherein the carrier profiles (10, 11; 25, 26) have two axes (s, w), the carrier profiles (10, 11; 25, 26) having different flexural stiffness along each of the two axes (s, w) given by one of (a) the geometry of the carrier profiles (10, 11; 25, 26), (b) the material of the carrier profiles (10, 11; 25, 26), and (c) the geometry and the material of the carrier profiles (10, 11; 25, 26), wherein the two axes (s, w) run perpendicular to each other.

20. The supporting spring system as claimed in claim 1, wherein the carrier profiles (10, 11; 25, 26) have axes (s, w), the carrier profiles (10, 11; 25, 26) having different flexural stiffness along each of the axes (s, w) perpendicular to each other in cross section, and in that the carrier profiles have greater dimensions in the direction of one of the axes than in the direction of another one of the axes.

21. The supporting spring system as claimed in claim 1, wherein the carrier profiles (10, 11; 25, 26) are held in lateral bearings, rotary bearings or pivoting bearings (27).

22. The supporting spring system as claimed in claim 1, wherein the carrier profiles (10, 11; 25, 26) are pultruded strips, pultruded rods or pultruded tubes.

23. Furniture for sleeping, sitting or reclining comprising a supporting spring system as claimed in claim 1.

24. A supporting spring system for furniture for sleeping, sitting or reclining, comprising a plurality of elongated, resilient carrier profiles (10, 11; 25, 26) that have a longitudinal axis and that run parallel to each other and that form a common plane, wherein the carrier profiles (10, 11; 25, 26) have two axes (s, w), the carrier profiles (10, 11; 25, 26) having different flexural stiffness along each of the two axes (s, w) given by one of (a) the geometry of the carrier profiles (10, 11; 25, 26), (b) the material of the carrier profiles (10, 11; 25, 26), and (c) the geometry and the material of the carrier profiles (10, 11; 25, 26), wherein the two axes (s, w) run perpendicular to each other and to a longitudinal axis (41, 42), wherein in each case at least two of the carrier profiles are coupled to one another to form a supporting unit, and wherein the at least two of the carrier profiles within the supporting unit are rotatable or pivotable.

25. The supporting spring system ac claimed in claim 24, wherein the carrier profiles (10, 11; 25, 26) are mounted on a bed frame, the bed frame having longitudinal members extending in a longitudinal direction, and the carrier profiles (10, 11; 25, 26) extend from one of the longitudinal members to another of the longitudinal members.

26. The supporting spring system as claimed in claim 25, wherein the carrier profiles (10, 11; 25, 26) extend transversely to the longitudinal direction, namely across a width of the bed frame.

27. Furniture for sleeping, sitting or reclining comprising a supporting spring system as claimed in claim 24.

* * * * *